United States Patent [19]

Bonser

[11] 4,165,074

[45] Aug. 21, 1979

[54] MECHANICAL TARGET

[76] Inventor: Norman L. Bonser, 2683 Oxford Ct., Eugene, Oreg. 97404

[21] Appl. No.: 853,485

[22] Filed: Nov. 21, 1977

Related U.S. Application Data

[63] Continuation-in-part of Ser. No. 672,519, Mar. 31, 1976, abandoned.

[51] Int. Cl.[2] ..... F41J 9/00

[52] U.S. Cl. ..... 273/105.6; 273/105.2

[58] Field of Search ..... 40/411, 472, 476; 198/482, 483; 273/102 R, 102 A, 102 S, 102.4, 105.2, 105.5, 105.6, 103, 127 R, 127 C

[56] References Cited

U.S. PATENT DOCUMENTS

| | | | |
|---|---|---|---|
| 1,047,989 | 12/1912 | Reeves | 273/105.2 |
| 1,639,596 | 8/1927 | Dritz | 273/105.2 X |
| 1,959,123 | 5/1934 | Chapman | 198/483 |
| 2,215,917 | 9/1940 | Dreyer | 273/105.2 |
| 2,297,993 | 10/1942 | Tratsch | 273/105.2 |
| 3,062,545 | 11/1962 | Richardson | 198/483 |
| 3,306,616 | 2/1967 | Baldwin et al. | 273/105.6 X |
| 3,328,033 | 6/1967 | Hendry | 273/103 X |

FOREIGN PATENT DOCUMENTS

| | | | |
|---|---|---|---|
| 141388 | 5/1923 | Fed. Rep. of Germany | 273/105.2 |

*Primary Examiner*—Vance Y. Hum

*Attorney, Agent, or Firm*—James D. Givnan, Jr.

[57] ABSTRACT

A cabinet housing mechanically actuated target components to provide multiple moving targets to the shooter. Rails guide gravitating ball members with scoring indicated by the upsetting of same off a rail. A ball transfer provides for transition of a gravitating ball from one rail to another. A ball lift mechanism includes a continuous conveyor including ball carriers. Elevation of a ball by the conveyor simultaneously cocks an ejector which discharges the ball onto an uppermost rail. The ball is confined, during lifting, for travel upwardly to progressively load the ejector which imparts initial velocity to the ball member target. A conveyor motor serves additionally to actuate reciprocating targets through a power takeoff arrangement.

9 Claims, 7 Drawing Figures

MECHANICAL TARGET

BACKGROUND OF THE INVENTION

The present application is a continuation-in-part of my copending U.S. patent application bearing the same title filed Mar. 31, 1976 under Ser. No. 672,519, and now abandoned.

The present invention concerns a mechanized target of the indoor or outdoor type with which shooters may improve their marksmanship.

For the most part, mechanical targets i.e., those having moving target members, are limited to use in commercial establishments or large training facilities by reason of their complexity and attendant cost. Such targets commonly affect movement of their numerous components by complicated linkages and drive trains rendering the initial cost of such targets beyond that which an individual user would pay. Further, the complex nature of mechanized targets incurs a substantial maintenance effort. Known in the prior art are target devices utilizing a belt type conveyor but which are limited to using discs as targets.

SUMMARY OF THE PRESENT INVENTION

The present invention is embodied within a target including a cabinet enclosure which houses various target components including multiple moving targets.

The present invention is embodied in a cabinet enclosure provided with inclined rail means along which ball members gravitate thereby providing moving targets with a score or hit indicated by the ball member being dislodged from the rail means. A ball lift mechanism includes a continuous belt which receives the metal ball-members for upward transfer to a discharge point whereat the ball is ejected onto said rail means. The lift mechanism includes ball ejector means imparting an initial velocity to the ejected ball element after it passes restraining means confining the ball. Additional target members are actuated both in vertical and horizontal directions to provide a target choice to the shooter. Doors for the cabinet enclosure may conveniently support a lighting arrangement to assure full target illumination. For noise reduction purposes the guide means, including the ball transfer arrangement and ball return, may include resilient components.

Important objects of the present mechanical target include: ball ejector means which is biased to a cocked position during upward ball movement and which forcefully discharges the ball upon the latter being proximate a ball discharge opening; ball ejector means which is of bail shape and which stabilizes each ball carrier during upward travel of the carrier; a lift mechanism wherein a continuous member is provided with novel spaced apart ball carriers capable of lifting the heavy metal balls with each of said carriers being in secured engagement with the belt at one point and additionally supported at a remote point by being in rested contact with the belt surface, such an arrangement enabling carrier pivotal passage about belt carrying spindles; a ball transfer arrangement accomplishing rapid, noiseless transfer from one rail to another of target guide means; a lift mechanism providing for the driving of reciprocating target elements via a power takeoff arrangement; a lift mechanism readily detachable from the enclosure for servicing if required; a compact target structure of a portable nature; a reticulated ball element return component through which spent projectiles may pass; and an inclined back stop deflecting projectiles downwardly after impact.

DETAILED DESCRIPTION OF THE PREFERRED EMBODIMENT

Figure 1:
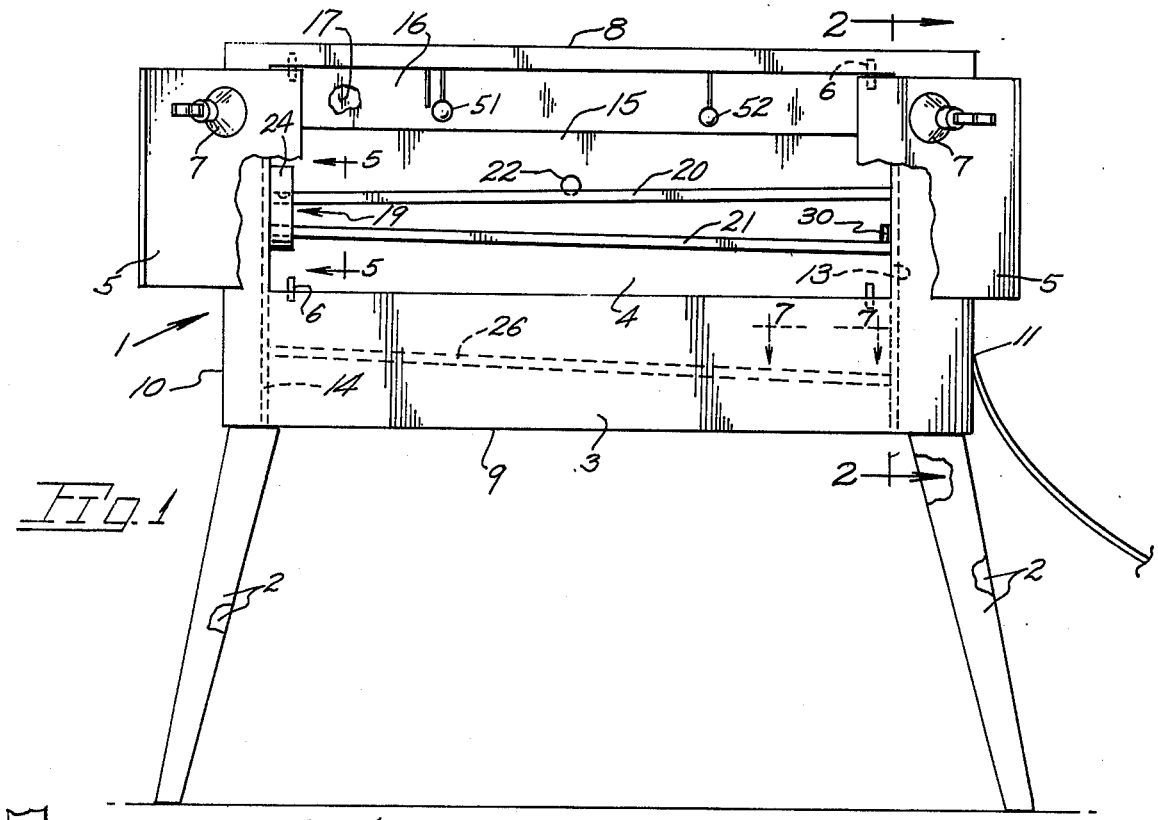
FIG. 1 is a front elevational view of the present target with enclosure doors in the open position.

With continuing reference to the accompanying drawings wherein applied reference numerals indicate parts similarly identified in the following description, reference numeral 1 indicates generally a cabinet or enclosure supported by legs 2 with a front wall 3 of the cabinet defining a frontal opening 4. Doors at 5 are hinged at 6, the doors also serving to mount floodlights at 7 for target illumination. Top and bottom walls of the cabinet are indicated at 8 and 9 with end walls at 10 and 11, the latter wall removable for access to a removable lift mechanism later described. A first partition at 13 defines, along with a portion of the cabinet walls, a housing for the lift mechanism as later described. Said first partition constitutes ball restraining means confining ball members during their elevation by the lift means. A second partition at 14 serves to support one end of later described guide means. Disposed within the cabinet is a backstop at 15 which is inclined forwardly to provide an inclined surface against which the projectiles impact. Backstop 15, as well as a covering 16 on the interior of a cabinet back wall 17, are of a synthetic resinous material capable of withstanding such impact.

Figure 5:
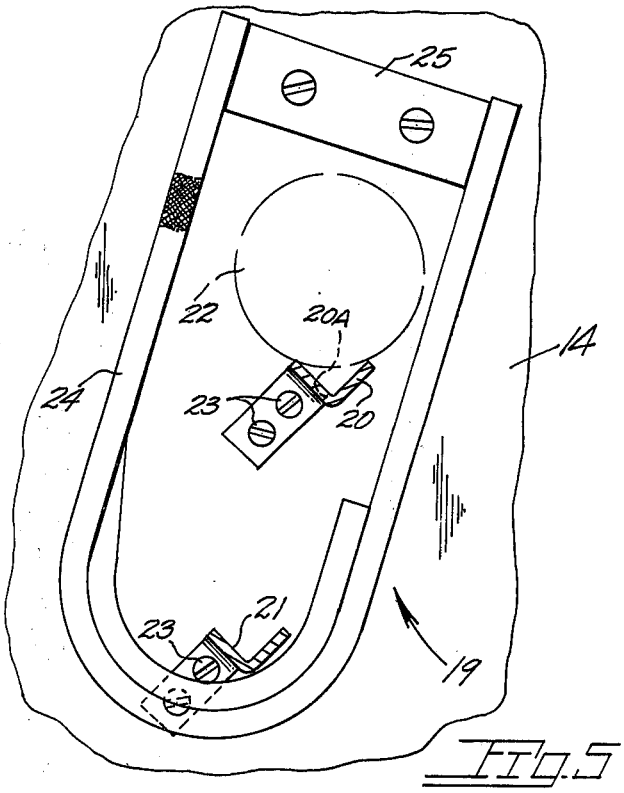
FIG. 5 is an enlarged elevational view taken along line 5—5 of FIG. 1 showing ball transfer details.

Disposed within the cabinet are ball guide means including V-shaped tracks or rails 20 and 21 traversed by heavy gravitating metal ball members indicated at 22 of approximately one and five-eighths inch diameter and twelve ounces in weight. Said rails are secured to partitions 13 and 14 as by outwardly turned, bifurcated rail ends, apertured for the reception of fasteners 23. Ball transfer means, indicated generally at 19, and as best viewed in FIG. 5 includes a U-shaped structure which transfers the metal ball members into place on the upper end of lower rail 21. Uppermost rail 20 is relieved at 20A to permit discharge of the ball member which, subsequently, is confined by yieldable material 24 into downward placement onto rail 21. A mounting block 25 supports the upper end of the yieldable material, yet permits the lower portion of same to yield under influence of ball weight. The semi-rigid material may be of the woven, synthetic fibre type used for carpeting outdoor surface areas. A further feature of the ball transfer means is that such may be set to vary the duration between rail transition of the ball members. For example, moving the mounting block 25 so as to relocate yieldable material in a right-hand direction in FIG. 5 will result in slowing the discharge of the ball member 22 from the relieved end of rail 20.

Figure 7:
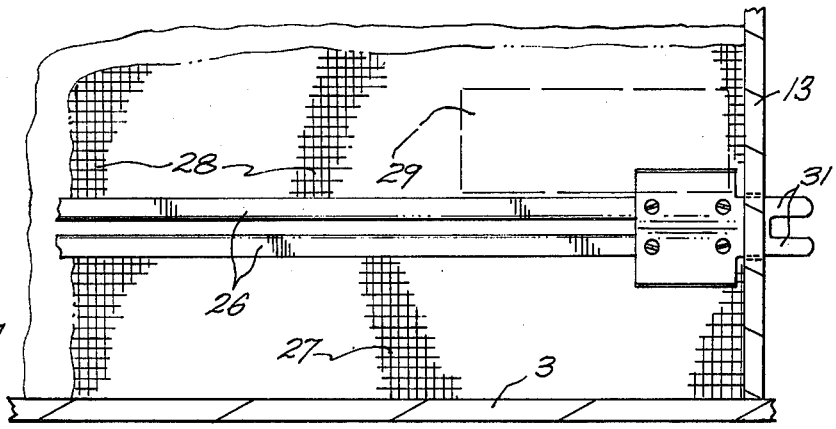
FIG. 7 is a plan view taken along line 7—7 of FIG. 1 showing details of a ball return structure.

As best viewed in FIGS. 1 and 7, a ball return structure includes rail elements 26 spaced apart to provide a return guideway for ball member passage toward one end of the cabinet. The ball return structure also includes sections of screen 27–28 secured to front wall 3 and back stop 15 respectively, each screen section inclined downwardly and inwardly so as to direct a ball member onto rails 26. For purposes of reducing noise, screen 28 may be provided with a resilient pad 29 onto which ball elements are discharged subsequent to contacting a stop 30 at the end of rail 21. Rails 26 jointly support finger-like extensions 31 for presenting a ball member to the following described lift mechanism.

Figure 2:
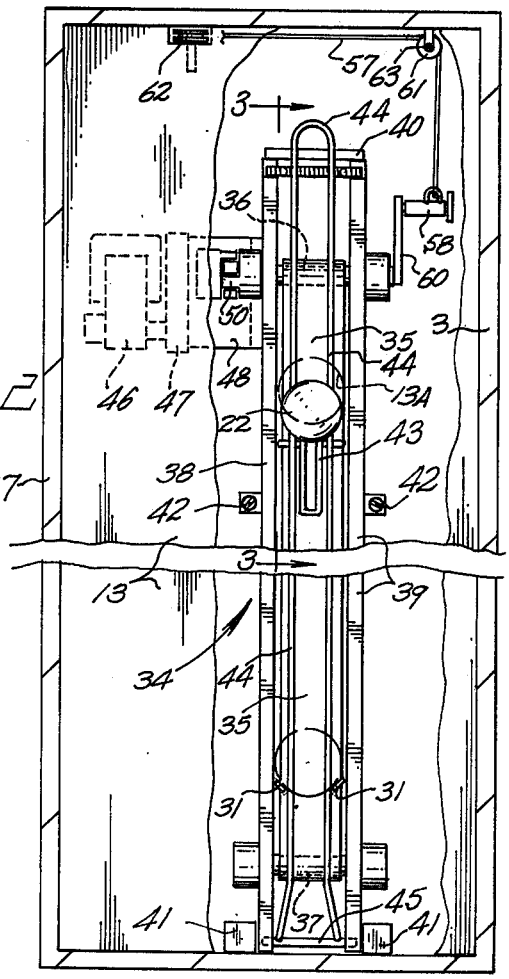
FIG. 2 is an elevational view taken along line 2—2 of FIG. 1 and sectioned for purposes of illustration.

A novel lift mechanism is indicated generally at 34 in FIG. 2, the same being enclosed with an end portion of the cabinet structure partially defined by partition 13. Said lift mechanism serves to elevate the heavy metallic ball members, received from rails 26 of the ball return and finger extensions 31, toward a ball discharge position whereat the ball member is discharged outwardly onto upper rail 20. A continuous conveyor member or belt 35 is of an elastomeric nature entrained about upper and lower spindles at 36 and 37 with one belt run facing toward the rails in offset parallel relationship to partition 13. Said spindles are suitably journalled within a conveyor framework including side members 38 and 39. A spacer at 40 also interconnects the frame members. Said framework is removably mounted in the cabinet by blocks 41, end wall 11 and fasteners 42.

Figure 3:
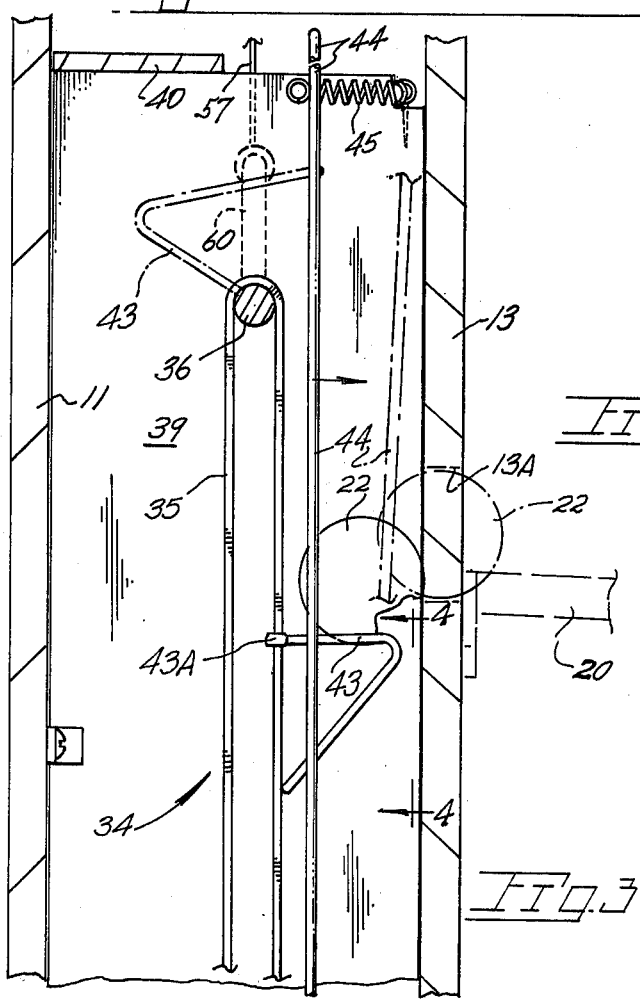
FIG. 3 is an enlarged elevational view of lift mechanism components taken along line 3—3 of FIG. 2.
Figure 4:
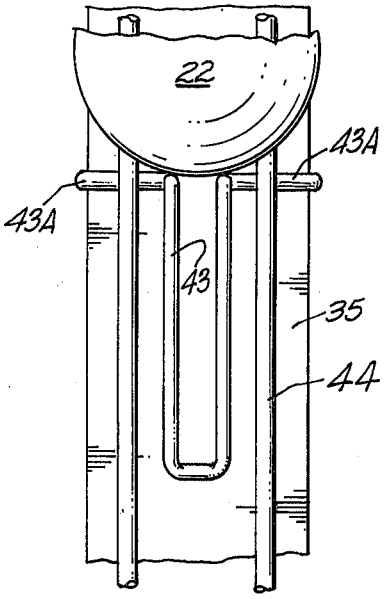
FIG. 4 is an enlarged elevational view of a ball carrier taken along line 4—4 of FIG. 3 showing carrier details.

Affixed along conveyor member 35 are novel spaced apart ball carriers as at 43 as best illustrated in FIG. 4. For purposes of conveyor securement, each carrier defines bight portions 43A which securely engage, as by crimping, the conveyor to secure the carrier thereto. A horizontal segment of the ball carrier serves to cradle the weighty ball member being lifted while a downwardly projecting portion terminates in supported rested contact with the conveyor surface. Outward tipping of the carrier 43 (FIG. 3) as it passes about spindles 36–37 is accordingly permitted. The frequency and force of ball member discharge from the lift mechanism may be varied by varying the spacing between carriers 43 on belt 35. Closely spaced carriers result in closely spaced ball ejections at slower speeds in view of the second ball member inhibiting movement of the ejector.

An ejector means includes a bail shaped discharge member at 44 which functions dually to discharge ball elements through an opening 13A in partition 13 and to stabilize the ball carriers 43 against lateral displacement during ball elevation. Said ejector means additionally includes a resilient component shown as spring 45 carried by conveyor frame members 38 and 39. Discharge member 44 is biased by spring 45 in a right-hand direction as viewed in FIG. 3 per the applied arrow toward the broken line position while the lower end 45 of member 44 is pivotally mounted within aligned sockets in the conveyor frame members. Intermittent ball discharge results from member 44 being progressively biased rearwardly (against spring 45) toward continuous conveyor member 35 as a ball element 22 is lifted by a carrier 43 toward partition opening 13A. The ball, during upward movement, exerts a progressive rearwardly biasing action to cock member 44 until such point as the ball member approaches opening 13A at which time it is ejected therethrough and onto rail 20.

A motor at 46 drives upper spindle 36 through a gear reduction drive being housed within a gear box 47 mounted by means of a bracket 48. A self-aligning coupling 50 compensates for any alignment discrepancies.

Figure 6:
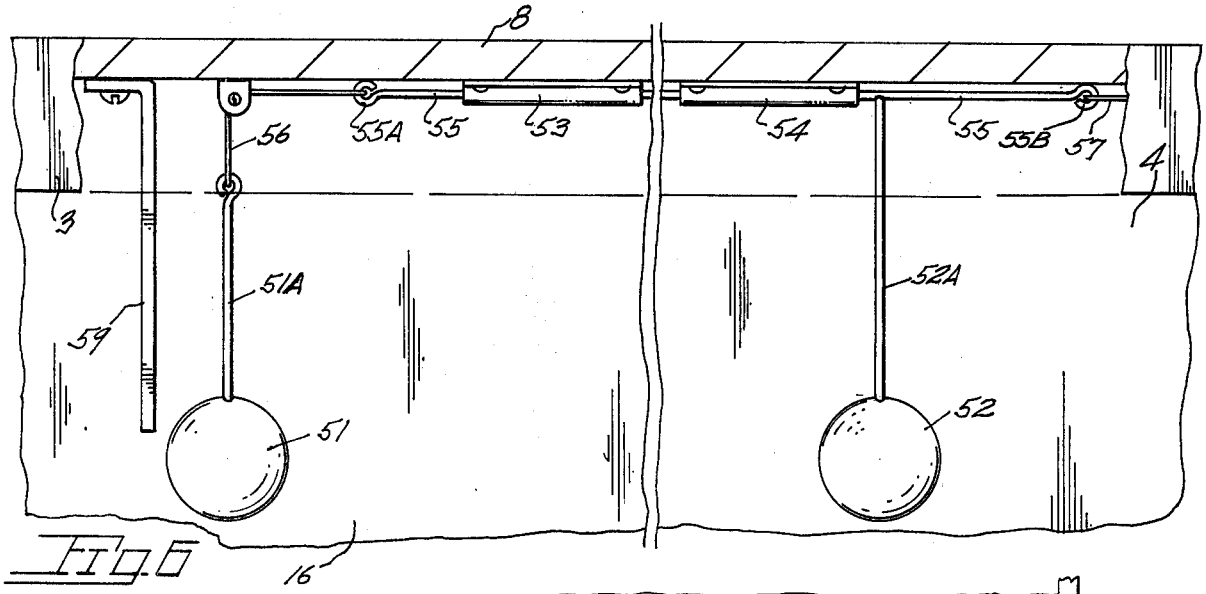
FIG. 6 is a fragmentary view of an upper portion of the cabinet type enclosure with fragments broken away to disclose a reciprocating target arrangement.

With attention jointly to FIGS. 2 and 6, an arrangement is disclosed therein to provide optional targets for the shooter in the form of vertically and horizontally reciprocating ball members at 51 and 52. The top wall 8 of the cabinet enclosure serves to mount sleeves 53 and 54 through which extends a rod 55 having an eye 55A to which is secured one end of a first flexible member 56 while the other end of said member suspends ball member 51 provided with a hanger 51A. Horizontally reciprocating ball member 52 also includes a stem at 52A which terminates upwardly in securement to rod 55. For the purpose of inhibiting swinging movement of ball member 51 upon being hit by a projectile, I provide a stop 59 suitably secured to the cabinet top wall. For imparting rectilinear motion to rod 55, a second flexible element 57 is secured to a sleeve 58 (FIG. 2) rotatably mounted on the outer end of an arm 60 affixed to the outer end of powered spindle 36. Flexible element 57 is entrained upwardly through a pulley 61 and thence through a second pulley 62, said element terminating in attachment to a rod eye 55B. Pulley 61 is mounted on a rod 63 in a slidable manner permitting axial displacement of the pulley along said rod permitting the pulley to follow the arm mounted collar 58 to assure continuous entrainment of element 57. The means provided to couple the motor 46 and reciprocating ball members thus includes both rigid and flexible components.

In operation, the lift mechanism continuously positions ball elements for discharge by the ejector means onto upper rail 20 with a score or hit indicated by the ball being knocked from the rail. The ball return returns both discharged ball members including those discharged by rail stop 30. Conveyor ball carriers 43 are spaced along conveyor 35 at intervals to at all times provide a visible ball member. The remaining operation of the target is believed to be apparent upon an understanding of the above description.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. A mechanical target for target shooting, said target comprising, an enclosure, ball members, ball guide means including inclined rails within said enclosure during the traversing of which a ball member constitutes a target, said rails forwardly spatially offset from a projectile backstop of the enclosure and lengthwise orientated within said enclosure, said guide means additionally including ball transfer means between adjacent rails ends for transfer of gravitating ball members therebetween, said transfer means including a yieldable member guiding said ball members during their downward transition from one rail end to the other rail end, a ball lift mechanism including a belt having one run facing toward said rails and receiving gravitating ball members discharged from said guide means, said lift mechanism including ball member carriers each of which is secured to one segment of said belt, each of said carriers also in rested contact with another segment of said belt during ball member elevation, stationary restraining means acting on said ball members to confine same against horizontal movement while on said lift mechanism, and ejector means acting on said ball members to unload same from said lift mechanism onto said rails, said ejector means including a spring biased discharge member movable between said one belt run and the stationary restraining means and gradually biased toward a cocked position adjacent said belt by a confined ball member during ball member upward travel on said lift mechanism.

2. The target claimed in claim 1 wherein said guide means includes a ball return structure including a pair of rail elements with finger extensions disposed on opposite sides of the ball member carrier path, and reticulated material partially supported by said rail elements through which spent projectiles may gravitate to the enclosure bottom.

3. The target claimed in claim 1 wherein said belt is of an elastomeric nature with the ball carriers disposed therealong and projecting outwardly therefrom through said ejector means to cradle a ball member, said carriers stabilized by said ejector means against lateral displacement, said belt carried by upper and lower spindles having their axes in offset parallel relationship to said stationary restraining means, said lift mechanism supported by a conveyor framework removably mounted in one end of said enclosure.

4. The target claimed in claim 3 wherein each of said carriers include a bight portion secured to the belt and a trailing portion in rested contact with the belt during elevation of a cradled ball member, said trailing portion displaceable away from the belt to enable passage of the belt about said spindles.

5. The target claimed in claim 1 wherein said ball discharge member is of elongate bail configuration pivotally mounted at one end, said discharge member located intermediate said belt and said restraining means and normally inclined along the path of a ball being lifted so as to be progressively and uniformly displaced by the ball member during its elevation to tension the resilient member.

6. The target claimed in claim 1 wherein said ball lift mechanism includes a motor, said target additionally including horizontally and vertically reciprocating ball elements, means coupling said reciprocating ball elements to said motor for producing horizontally and vertically reciprocating motion.

7. The target claimed in claim 6 wherein said coupling means includes a target actuating rod slidably supported on said enclosure, a first flexible element associated with said actuating rod to translate horizontal rod motion into vertical motion, a second flexible element operatively coupling the motor to said rod, a pulley axially displaceable to follow excursions of said second flexible element to prevent disentrainment of said second flexible element from said pulley.

8. The target claimed in claim 1 wherein said yieldable member additionally serves to inhibit downward movement of a transitioning ball member as determined by the proximity of the yieldable member to one side of said one rail end.

9. The target claimed in claim 1 wherein said ball member carriers are in crimped engagement with said belt permitting selective ball carrier spacing on said belt to enable varying the duration between ball ejections and the force at which the ball member ejections occur.

* * * * *